United States Patent [19]

Houlberg

[11] Patent Number: 4,514,876

[45] Date of Patent: May 7, 1985

[54] INJECTION MOULDED BAG CLOSURE

[76] Inventor: Jørn P. Houlberg, Studsgade 40, DK-8000 Århus C., Denmark

[21] Appl. No.: 314,078

[22] PCT Filed: Feb. 12, 1981

[86] PCT No.: PCT/DK81/00014

§ 371 Date: Oct. 13, 1981

§ 102(e) Date: Oct. 13, 1981

[87] PCT Pub. No.: WO81/02284

PCT Pub. Date: Aug. 20, 1981

[30] Foreign Application Priority Data

Feb. 12, 1980 [DK] Denmark ..... 598/80

[51] Int. Cl.[3] ..... B65D 33/24

[52] U.S. Cl. ..... 16/110 R; 383/15

[58] Field of Search ..... 294/137, 152, 142, 16, 294/74; 229/52 A, 52 R, 54 R, 54 C; 270/94 R; 16/110 R, 110.5; 150/12, 5; 190/55 R; 383/13, 15, 68

[56] References Cited

U.S. PATENT DOCUMENTS

| | | | |
|---|---|---|---|
| 2,769,587 | 11/1956 | Threeton | 294/142 |
| 3,310,224 | 3/1967 | Laguerre | 383/15 |
| 3,363,827 | 1/1968 | Renner et al. . | |
| 3,462,068 | 8/1969 | Suominen . | |
| 3,558,039 | 1/1971 | Schmidt | 383/15 X |
| 3,665,551 | 5/1972 | Ender | 229/54 R |
| 3,692,218 | 9/1972 | Friedman | 383/15 X |

FOREIGN PATENT DOCUMENTS

| | | | |
|---|---|---|---|
| 706737 | 3/1965 | Canada | 383/15 |
| 122316 | 7/1972 | Denmark . | |

*Primary Examiner*—Johnny D. Cherry

*Attorney, Agent, or Firm*—Watson, Cole, Grindle & Watson

[57] ABSTRACT

Bag closure comprising two bag carrying bars interconnected at their ends, closure means or handle parts, which are connected to the upper sides of the carrying bars and, at least one of which is connected to the associated carrying bar via a flexible connecting piece which is initially essentially perpendicular to the corresponding carrying bar.

The use of the connecting piece allows the closure to be produced by moulding in a simple mould and at a high production rate.

4 Claims, 3 Drawing Figures

INJECTION MOULDED BAG CLOSURE

BACKGROUND OF THE INVENTION

This invention relates to an injection moulded bag closure device comprising two parallel carrying bars which at their ends are interconnected through connecting means extending over substantially the full height of the bars, the bars being adapted to be connected to opposite portions of the open end of a bag, and closure or handle parts connected to the upper edges of the carrying bars.

Various closure devices for carrying bags are well known, these closure devices comprising carrying bars and connecting elements which are moulded in one operation, each carrying bar having attached to its upper edge a handle part, the two handle parts having a shape such that they can be interlocked, thus also interlocking the carrying bars.

Thus, a well known bag closure device comprises two parts having the shape of a closed handle and the opening in one handle part having a shape such that the other handle part can be inserted therein and can be brought into engagement with the first handle part by means of a hook-shaped part on the outer side of the first part. In another well known bag closure device comprising two hook-shaped handle parts there is provided in the handle part of the first carrying bar an elongated hole which is parallel to the carrying bar in the zone just above the bar, said hole having a size such that the handle part of the second carrying bar can be inserted into the hole and be placed essentially parallel to the outer side of the former handle part and into engagement therewith. The above-mentioned closure devices are prepared by injection moulding in a jaw tool in which each handle part forms an angle of 10° to the plane of the corresponding carrying bar. It is necessary to use such a jaw tool in order to prepare the two carrying bars so as to be integrally connected at their ends.

Due to the very acute angle between the two handle parts, it is difficult to cool the mould in the zone adjacent to the two carrying bars and consequently a desired high production rate cannot be obtained. Furthermore, the use of such a jaw tool results in the formation of sharp edges on the two handle parts and, therefore, the combined handle may cut into a person's hands when heavy articles are transported in bags having such a handle.

The object of the invention is to provide a bag closure device which can be manufactured in a simpler manner and quicker than the above-mentioned prior art closure device.

SUMMARY OF THE INVENTION

According to the present invention the bag closure device includes at least one closure or handle part which is connected to the upper edge of the corresponding carrying bar via a flexible connecting piece which is moulded essentially perpendicularly to the carrying bar.

The provision of the connecting piece connected to the upper edge of a carrying bar and extending outwardly therefrom essentially at a right angle has the effect that a far simpler injection tool than the above-mentioned jaw tool can be used and that an efficient cooling of all parts of the tool can be performed.

Due to the flexibility of the connecting piece, one part of the closure or one handle part can easily be combined with the other part of the closure or other handle part in spite of the fact that when removed from the mould, it extends perpendicularly outwardly from the carrying bar. It is preferred that each part of the closure or handle part extend essentially perpendicularly outwardly from its carrying bar and the following explanation of the invention is based on this preferred embodiment.

In order to make it easier to bring the two parts of the closure means or the two handle parts together and to ensure that the connecting pieces are bent in the same zone when they are brought together or are separated, each connecting piece preferably include a weakening line extending parallel to the upper edge of the carrying bar.

By localizing the bending movement to specific zones, very stable hinges are obtained with the hinges are made from, plastic material, e.g., polypropylene. Furthermore, it is ensured that the bending takes place in a predetermined zone which is essential to the function of the closure device and enable the closing operation to be effected mechanically.

The handle parts connected to the carrying bars may be closed or in the shape of hooks so that the closure can be used in connection with carrying bags and/or bags for the display of goods in shops. Due to the fact that the handle parts extend from the carrying bars in different directions, the bags are easy to open and are consequently suitable for mechanical packing of goods. The opening of such bags may be effected by forcing the carrying bars away from one another as a result of a pull in the handle parts extending in opposite directions and when the goods are being packed, the handle parts are kept out of the zone through which the goods are introduced into the bag to which the closure is attached.

The handle parts are preferably U-shaped and the width of the U-profile of one handle part is preferably so much less than the width of the U-profile of the other handle part that the former U-profile can be inserted in the latter with the open ends of the U-profiles facing one another. The handle thus formed has no sharp edges.

Instead of attaching handle parts directly to the carrying bars, they may be connected to closure means attached to the bars. When both the closure means and the handle parts form part of the closure, the closure means preferably comprise a hook provided on the exterior side of the relatively narrow U-profile of one handle part, this hook having a shape such that it can be inserted on a corresponding shoulder-shaped part on the interior side of the wide U-profile of the second handle part so as to lock the two parts together.

The closure means are preferably located in close proximity of the connecting pieces in order to ensure that the hook and the shoulder-shaped part fit exactly together when the handle parts are moved towards one another and because in that case the closed bag is difficult to open with one hand and the contents thereof cannot be removed unnoticed.

A further protection against unnoticed opening of a closed bag can be obtained by providing one handle part with a weakening line located some distance from the upper edge of the carrying bar and parallel thereto. The presence of such a weakening line has the effect that two hands have to be used to open the closure because the two handle parts have to be pulled away from one another.

The two handle parts may be interlocked in another or a further way by providing on that part of the narrow U-profile of one handle which is remote from the carrying bar a flange having a dimension such that it can be inserted into and maintained in an incision in the wide U-profile of the second handle part.

The invention will now be described in further detail with reference to the drawings.

DETAILED DESCRIPTION OF THE PREFERRED EMBODIMENTS

Figure 1:
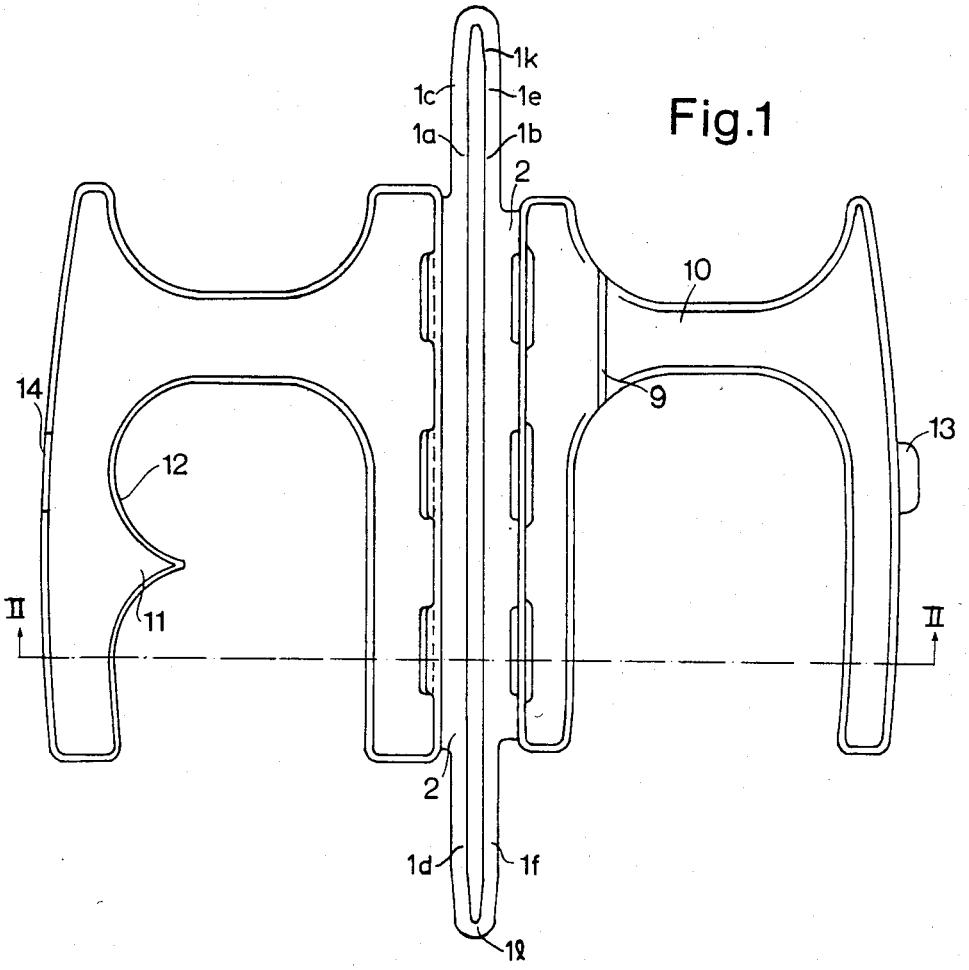
FIG. 1 shows a top view of one embodiment of a bag closure device constructed according to the present invention.
Figure 2:
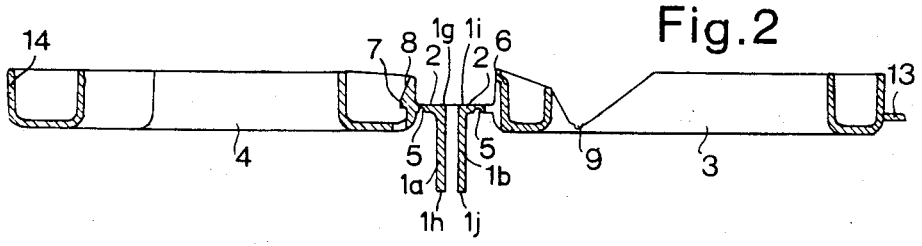
FIG. 2 shows a sectional view along the line II—II of the bag closure device illustrated in FIG. 1.
Figure 3:
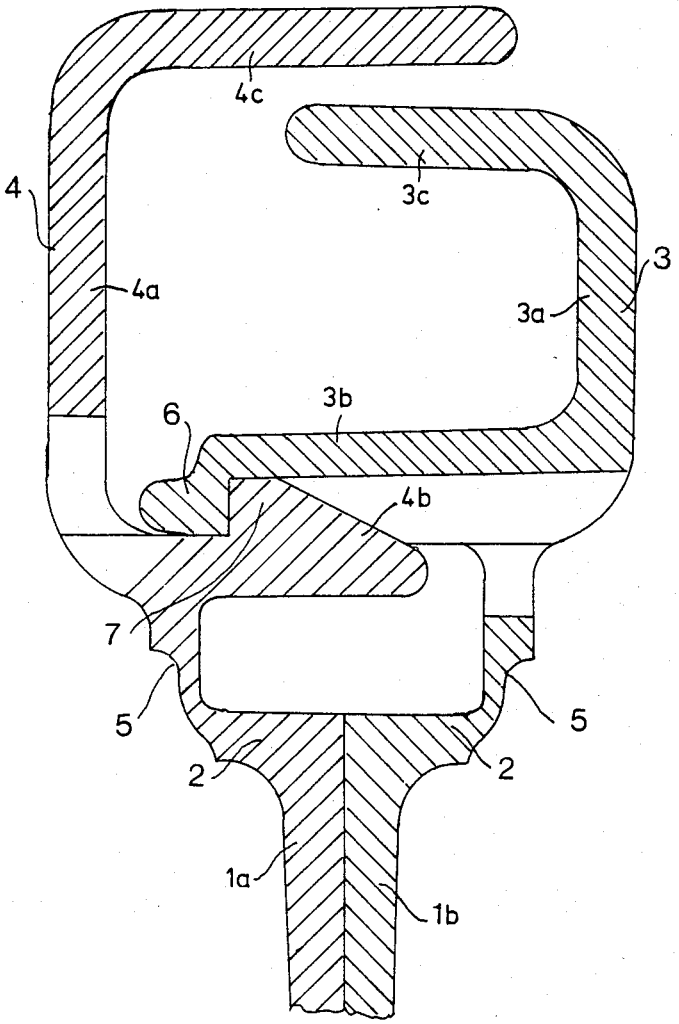
FIG. 3 shows an enlarged sectional view of a portion of the bag closure device according to the invention wherein the two handle parts thereof are interlocked.

As seen in FIGS. 1 and 2, which show a preferred embodiment of a bag closure device according to the present invention, the bag closure device includes two parallel carrying bars 1*a*, 1*b* are in the form of elongated strips that, as seen in FIG. 2, are oriented with their elongated dimension extending horizontally and their width dimension extending vertically, thus providing respective opposite ends 1*c*, 1*d* and 1*e*, 1*f* and respective upper and lower sides 1*g*, 1*h* and 1*i*, 1*j*. The strips are interconnected at their ends, and along their entire width dimension, by connector portions 1*k*, 1*l*. The upper side of each bar 1*a*, 1*b* is connected via a connecting piece 2, which extends outwardly from the respective bar at an angle of about 90° to a handle part 3,4. Each of the two handle parts 3,4 include base walls 3*a*, 4*a*, inner walls, 3*b*, 4*b* and outer side walls 3*c*, 4*c* which provide U-shaped profile cross section with the open side of each U profile facing upwardly. The base wall of the handle part 4 is wider than that of the handle part 3 so that the handle part 3 can be inserted into the handle part 4, cf. FIG. 3, when the two parts are brought together. Each connecting piece 2 has a portion of reduced cross section so as to form a weakened line 5 which extends parallel to the adjoining carrying bar 1*a*, 1*b*. The illustrated bag closure includes locking means which are illustrated in detail in FIG. 3.

Thus, the exterior side of the U-shaped handle part 3 which is located close to its associated carrying bar 1*b* includes a hook 6 which faces the other carrying bar 1*a*, whereas the interior side of the corresponding portion of the handle part 4 has a shoulder part 7 which extends away from its associated carrying bar 1*a* the shoulder-shaped part 7 having a shape corresponding to that of the hook 6. The above-mentioned portion of the handle part 4 also includes an inclined surface 8 located between the shoulder-shaped part 7 and the upper edge of the U-profile.

The handle part 3 also includes a portion of reduced cross section so as to form a weakened line 9 which is parallel to its associated carrying bar 1*b* and which is located in a zone 10 connecting the two essentially parallel portions of the handle part.

The outermost arm portion of the handle part 4 includes an extension 11 on the side facing its associated carrying bar 1*a* the extension 11 forming a hook-shaped edge 12 which permits the closed handle to be hung on a bar in a predetermined position.

The arm portion of its associated handle part 3 which is remote from the carrying bar 1*b* includes a flange 13 on its exterior side having a length such that it can be inserted into and maintained in a corresponding incision 14 in the corresponding portion of the handle part 4.

When the illustrated bag closure has been removed from the mould and the article to be packed has been introduced into the corresponding bag, the two handle parts 3,4 are swung towards one another. During this movement the handle parts will bend at their portions of reduced cross section, such that the weakened lines 5 will function as hinges. During the continued movement, the hooks 6 on the handle part 3 contact the inclined surfaces 8 on the handle part 4 and slide along these surfaces until the hooks 6 are brought into engagement with the shoulder-shaped parts 7, thus interlocking the two parts 3,4.

When the portions of the handle parts 3 and 4 which are located closest to one another have been interlocked, the remotest portions can be interlocked by introducing the flange 13 of the handle part 3 into the incision 14 of the handle part 4.

The removal of the flange 13 from the incision 14 and the swinging of that portion of the handle part 3 which is remote from the carrying bar 1*b* away from the handle part 4 will not automatically cause the carrying bars to be unlocked from one another because the handle part will bend along the weakened line 9. In order to force the carrying bars 1*a*, 1*b* away from one another, a force has to be applied to both the handle part 3 and the handle part 4.

The locking system consisting of hooks 6 and corresponding shoulder-shaped parts present the further advantage that the contact between the two handle parts is strengthened with increasing loads on the carrying bars. The bag closure according to the invention is, therefore, particularly suitable for use with bags for carrying heavy articles.

I claim:

1. An injection molded plastic closure device for a bag having a mouth, said closure device comprising:

a pair of parallel carrying bars which are attachable to opposite sides of the mouth of the bag, each of said carrying bars having an elongated dimension and a width dimension and each of said carrying bars, when oriented such that its elongated dimension is horizontal and its width dimension is vertical, defining opposite end portions and upper and lower side edges, said carrying bars also defining imaginary vertical planes in their width dimensions, connector portions integrally connecting the respective associated opposite end portions of said carrying bars along their entire width dimensions, and closure members respectively connected to the upper side edges of said carrying bars, each of said closure members including a handle part and at least one of said closure members including a flexible connecting part; each said flexible connecting part extending between the associated carrying bar and the associated handle part and each said flexible connecting part being integrally molded with the associated carrying bar to initially extend in a plane perpendicular to the imaginary vertical plane defined by the associated carrying are, each said flexible connecting part including a portion of reduced thickness which forms a weakening line that extends in parallel with the upper edge of the associated carrying bar; and wherein the handle part of each said closure member includes a base wall, inner and outer side walls and an open side, thus forming a U-shaped cross section, the base wall of the handle part of a first of said closure members having a lesser width between its associated inner and outer side walls than the base wall of the handle part of a second of said closure members, such that when said closure members are brought together to close the mouth of the bag, the open sides of the handle parts thereof will face one another and the handle part of said first closure member will fit within the handle part of said second closure member.

2. An injection molded plastic bag closure device as defined in claim 1 wherein the handle part of said second closure member includes a shoulder portion on its inner side wall and wherein the inner side wall of the handle part of said first closure member includes a hook portion, said hook portion of said first handle part interlocking with said shoulder portion of said second handle part when said closure members are brought together.

3. An injection molded plastic bag closure device as defined in claim 1 wherein each said handle part includes an arm portion remote from its associated carrying bar which is generally parallel to the upper side edge of its associated carrying bar, the arm portion of the handle part of one of said closure members including a cut-out area and the arm portion of the handle part of the other of said closure members including a flange, said flange fitting into said cut-out area when said closure members are brought together.

4. An injection molded plastic bag closure device as defined in claim 1 wherein a handle part of at least one of said closure members includes a portion of reduced thickness which forms a weakening line that extends in parallel with the upper edge of the associated carrying bar.

* * * * *